US007653537B2

(12) United States Patent
Padhi et al.

(10) Patent No.: US 7,653,537 B2
(45) Date of Patent: Jan. 26, 2010

(54) METHOD AND SYSTEM FOR DETECTING VOICE ACTIVITY BASED ON CROSS-CORRELATION

(75) Inventors: Kabi Prakash Padhi, Singapore (SG); Sapna George, Singapore (SG)

(73) Assignee: STMicroelectronics Asia Pacific Pte. Ltd., Singapore (SG)

( * ) Notice: Subject to any disclaimer, the term of this patent is extended or adjusted under 35 U.S.C. 154(b) by 798 days.

(21) Appl. No.: 10/951,545

(22) Filed: Sep. 28, 2004

(65) Prior Publication Data

US 2005/0182620 A1 Aug. 18, 2005

(30) Foreign Application Priority Data

Sep. 30, 2003 (SG) ..... 200305524-1

(51) Int. Cl.
*G10L 19/00* (2006.01)
*G10L 19/14* (2006.01)
*G10L 21/00* (2006.01)

(52) U.S. Cl. ..... 704/218; 704/211; 704/214; 704/216; 704/226; 704/228

(58) Field of Classification Search ..... 704/233, 704/211, 218, 234
See application file for complete search history.

(56) References Cited

U.S. PATENT DOCUMENTS 5,485,522 A * 1/1996 Solve et al. ..... 381/56
5,699,477 A * 12/1997 McCree ..... 704/216
5,749,067 A * 5/1998 Barrett ..... 704/233
6,049,766 A * 4/2000 Laroche ..... 704/216
6,188,981 B1 * 2/2001 Benyassine et al. ..... 704/233
6,279,379 B1 * 8/2001 Logue et al. ..... 73/24.01
6,332,143 B1 * 12/2001 Chase ..... 707/100
6,427,134 B1 * 7/2002 Garner et al. ..... 704/233
6,453,285 B1 * 9/2002 Anderson et al. ..... 704/210
6,691,092 B1 * 2/2004 Udaya Bhaskar et al. ... 704/265
2003/0110029 A1 * 6/2003 Ahmadi et al. ..... 704/233
2003/0142750 A1 * 7/2003 Oguz et al. ..... 375/240.18
2004/0064314 A1 * 4/2004 Aubert et al. ..... 704/233

* cited by examiner

*Primary Examiner*—David R Hudspeth
*Assistant Examiner*—Justin W Rider
(74) *Attorney, Agent, or Firm*—David V. Carlson; Lisa K. Jorgenson

(57) ABSTRACT

A system and method is provided for determining whether a data frame of a coded speech signal corresponds to voice or to noise. In one embodiment, a voice activity detector determines a cross-correlation of data. If the cross-correlation is lower than a predetermined cross-correlation value, then the data frame corresponds to noise. If not, then the voice activity detector determines a periodicity of the cross-correlation and a variance of the periodicity. If the variance is less than a predetermined variance value, then the data frame corresponds to voice. In another embodiment, a method determines energy of the data frame and an average energy of the coded speech signal. If the data frame is one of a predetermined number of initial data frames, then a comparison between the average energy to the energy of the data frame is used to determine whether the data frame is noise or voice.

19 Claims, 10 Drawing Sheets

METHOD AND SYSTEM FOR DETECTING VOICE ACTIVITY BASED ON CROSS-CORRELATION

BACKGROUND OF THE INVENTION

1. Field of the Invention

The present invention relates to a voice activity detector, and a process for detecting a voice signal.

2. Description of the Related Art

In a number of speech processing applications it is important to determine the presence or absence of a voice component in a given signal, and in particular, to determine the beginning and ending of voice segments. Detection of simple energy thresholds has been used for this purpose, however, satisfactory results only tend to be obtained where relatively high signal to noise ratios are apparent in the signal.

Voice activity detection generally finds applications in speech compression algorithms, karaoke systems and speech enhancement systems. Voice activity detection processes typically dynamically adjust the noise level detected in the signals to facilitate detection of the voice components of the signal.

The International Telecommunication Union (ITU) prescribes the following standards for a voice activity detector (VAD):

1. ITU-T G.723.1 Annex A, Series G: Transmission Systems and Media, "Silence compression scheme", 1996.

2. ITU-T G.729 Annex B, Series G: Transmission Systems and Media, "A silence compression scheme for G.729 optimized for terminals conforming to recommendation V.70", 1996.

The European Telecommunication Standards Institute (ETSI) prescribes the following standard for a VAD:

1. ETSI EN 301 708 V7.1.1, Digital cellular telecommunications system (Phase 2+); "Voice Activity Detector (VAD) for adaptive Multi-Rate (AMR) speech traffic channels: general description", 1999.

The basic function of the ETSI VAD is to indicate whether each 20 ms frame of an input signal sampled at 16 kHz contains data that should be transmitted, i.e., speech, music or information tones. The ETSI VAD sets a flag to indicate that the frame contains data that should be transmitted. A flow diagram of the processing steps of the ETSI VAD is shown in FIG. 1. The ETSI VAD uses parameters of the speech encoder to compute the flag.

The input signal is initially pre-emphasized and windowed into frames of 320 samples. Each windowed frame is then transformed into the frequency domain using a Discrete Time Fourier Transform (DTFT).

The channel energy estimate for the current sub-frame is then calculated based on the following:

1. the minimum allowable channel energy;
2. a channel energy smoothing factor;
3. the number of combined channels; and
4. elements of the respective low and high channel combining tables.

The channel Signal to Noise Ratio (SNR) vector is used to compute the voice metrics of the input signal. The instantaneous frame SNR and the long-term peak SNR are used to calibrate the responsiveness of the ETSI VAD decision.

The quantized SNR is used to determine the respective voice metric threshold, hangover count and burst count threshold parameters. The ETSI VAD decision can then be made according to the following process:

```
If ( v(m)>v th + μ(m) )
{       /       *if the voice metric > voice metric threshold*/
    VAD(m)=ON
    B(m)=b(m−1)+1           /* increment burst counter*/
    If ( b(m)>b th )
    {           /*compare counter with threshold */
                h(m)=h cnt      /* set hangover*/
    }
}
else
{
    b(m) = 0                    /* clear burst counter */
    h(m)=h(m−1) −1          /* decrement hangover /
    if ( (h(m) <= 0 )
    {       /* check for expired hangover */
        VAD(m)=OFF
        H(m)=0
    }
    else
    {       /* hangover not yet expired */
        VAD(m) = ON
    }
}
```

To avoid being over-sensitive to fluctuating, non-stationary, background noise conditions, a bias factor may be used to increase the threshold on which the ETSI VAD decision is based. This bias factor is typically derived from an estimate of the variability of the background noise estimate. The variability estimate is further based on negative values of the instantaneous SNR. It is presumed that a negative SNR can only occur as a result of fluctuating background noise, and not from the presence of voice. Therefore, the bias factor is derived by first calculating the variability factor. The spectral deviation estimator is used as a safeguard against erroneous updates of the background noise estimate. If the spectral deviation of the input signal is too high, then the background noise estimate update may not be permitted.

The ETSI VAD needs at least 4 frames to give a reliable average speech energy with which the speech energy of the current data frame can be compared.

A typical problem faced by a VAD is misclassification of the input signal into voice/silence regions. Some standard algorithms vary the noise threshold dynamically across a number of frames and produce more accurate VAD estimates with time. However, the complexity of these VADs is relatively high. The complexity of the ETSI VAD may be given as follows:

$$ETSI\ VAD=\{2\cdot O(L)+O(M\cdot\log_2(M)+4\cdot O(N_c)\}\ \text{operations}$$

where

Nc is the number of combined channels;

L is the subframe length; and

M is the DFT length.

Windowing and pre-emphasis both have an order of O(L). The Discrete Time Fourier Transform has an order of $O(M\cdot\log_2(M))$. The channel energy estimator, Channel SNR estimator, voice metric calculator and Long-term Peak SNT calculator each have complexity of the order of $O(N_c)$.

These VADs are typically not efficient for applications that require low-delay signal dependant estimation of voice/silence regions of speech. Such applications include pitch detection of speech signals for karaoke. If a noisy signal is determined to be a speech track, the pitch detection algorithm may return an erroneous estimate of the pitch of the signal. As a result, most of the pitch estimates will be lower than expected, as shown in FIG. 2. The ETSI VAD supports a low-delay VAD estimate based on a pre-fixed noise thresholds, however, these thresholds are not signal dependent.

An object of the present invention is to overcome or ameliorate one or more of the above mentioned difficulties, or at least provide a useful alternative.

BRIEF SUMMARY OF THE INVENTION

In accordance with the present invention, there is provided a method for determining whether a data frame of a coded speech signal corresponds to voice or to noise, including the steps of:

determining the cross-correlation of the data of said data frame;

determining the periodicity of the cross-correlation;

determining the variance of the periodicity;

determining said data frame corresponds to noise if the cross-correlation is lower than a predetermined cross-correlation value; and determining the data corresponds to voice if the variance is less than a predetermined variance value.

The present invention also provides a method for determining whether a data frame of a coded speech signal corresponds to voice or to noise, including the steps of:

determining an energy of said frame;

determining an average speech energy of the coded speech signal;

if the data frame is one of a predetermined number of initial data frames of the coded speech signal, performing the method referred to above; and else, comparing the energy of the frame with the average speech energy, and the data frame corresponds to speech if the average speech energy is less than or equal to that of the energy of the frame.

The present invention also provides a voice activity detector for determining whether a data frame of a coded speech signal corresponds to voice or to noise, including:

means for determining the cross-correlation of the data of said data frame;

means for determining the periodicity of the cross-correlation;

means for determining the variance of the periodicity;

means for determining said data frame corresponds to noise if the cross-correlation is lower than a predetermined cross-correlation value; and means for determining the data corresponds to voice if the variance is less than a predetermined variance value.

BRIEF DESCRIPTION OF THE DRAWINGS

Preferred embodiments are hereafter described, by way of non-limiting example only, with reference to the accompanying drawings in which.

DETAILED DESCRIPTION OF THE INVENTION

Figure 3:
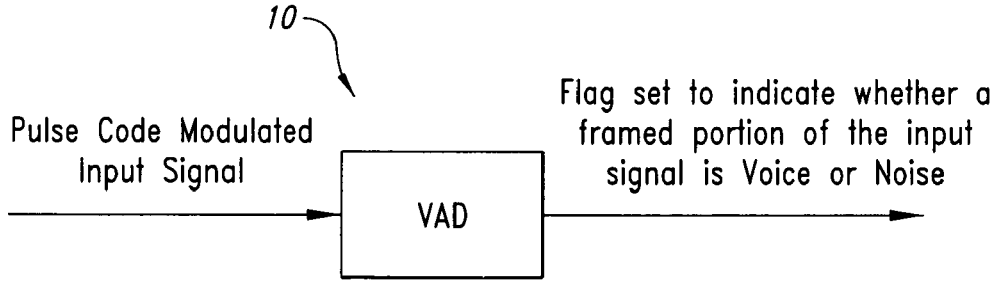
FIG. 3 is a diagrammatic illustration of a voice activity detector in accordance with a preferred embodiment of the invention.
Figure 4:
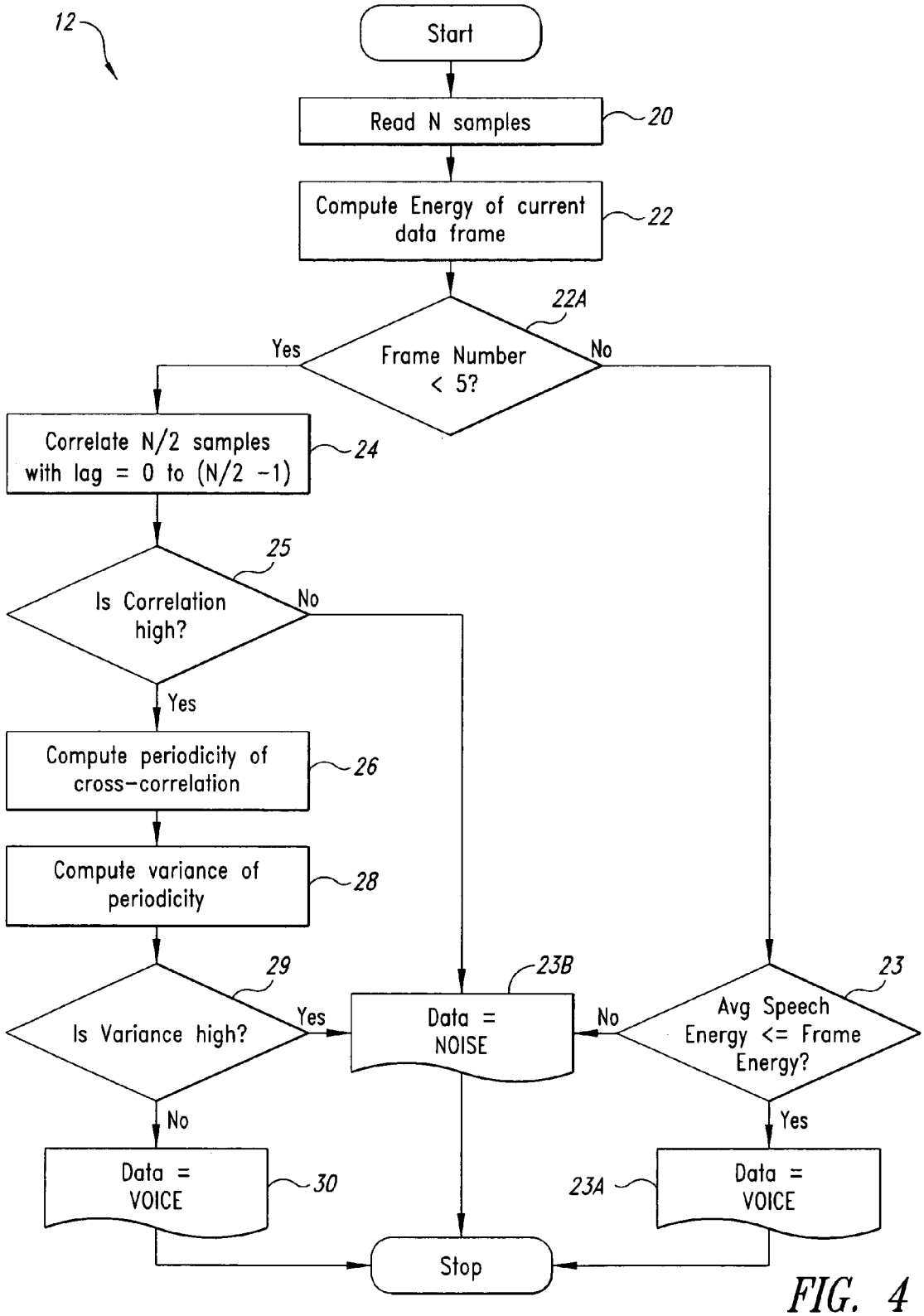
FIG. 4 is a flow diagram showing a process preferred by the voice activity detector.
Figure 5A:
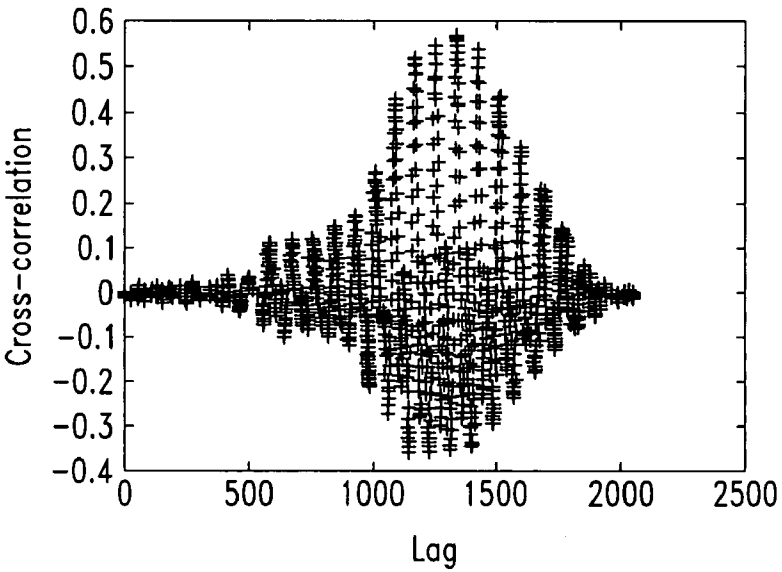
FIGS. 5A-5D shows the frequency spectrum and cross-correlation of speech and noise signals.
Figure 5A:
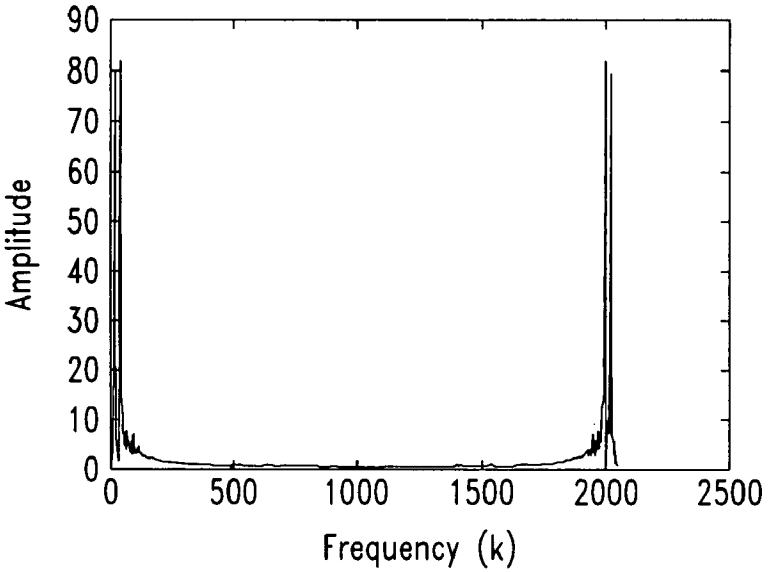
Figure 5B:
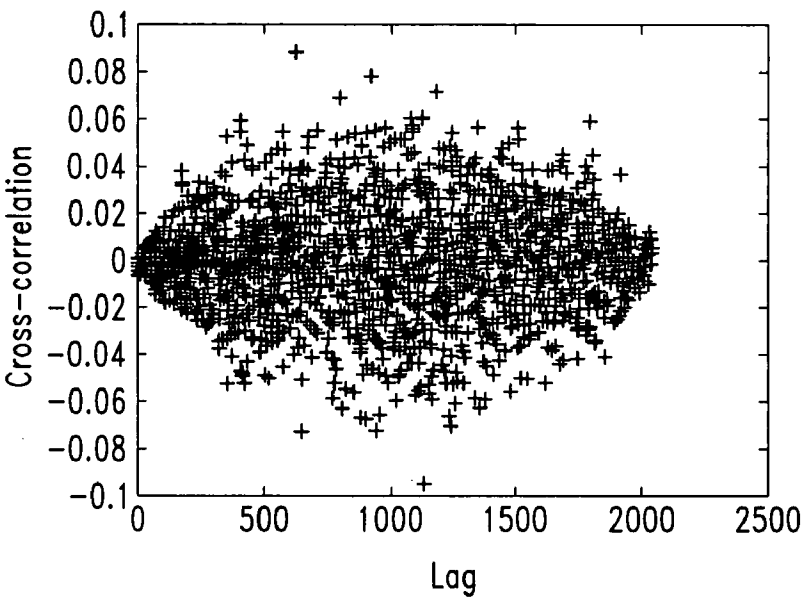
Figure 5B:
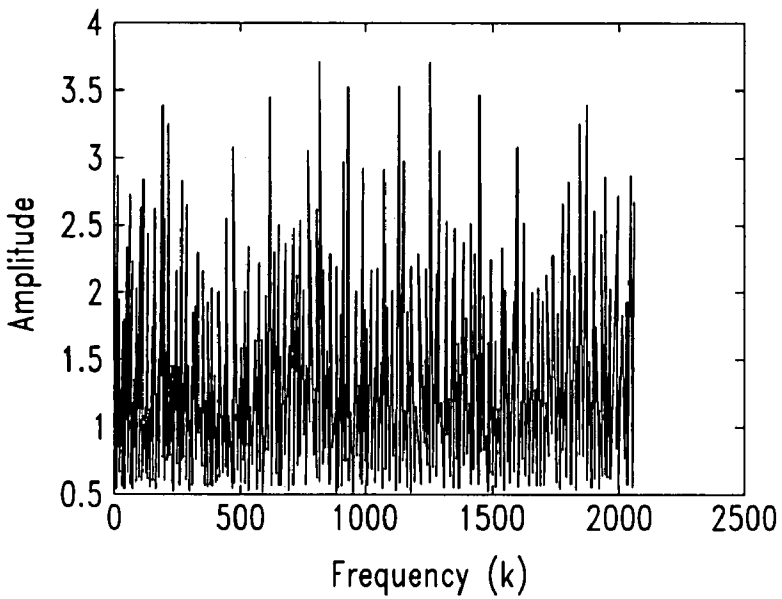
Figure 5C:
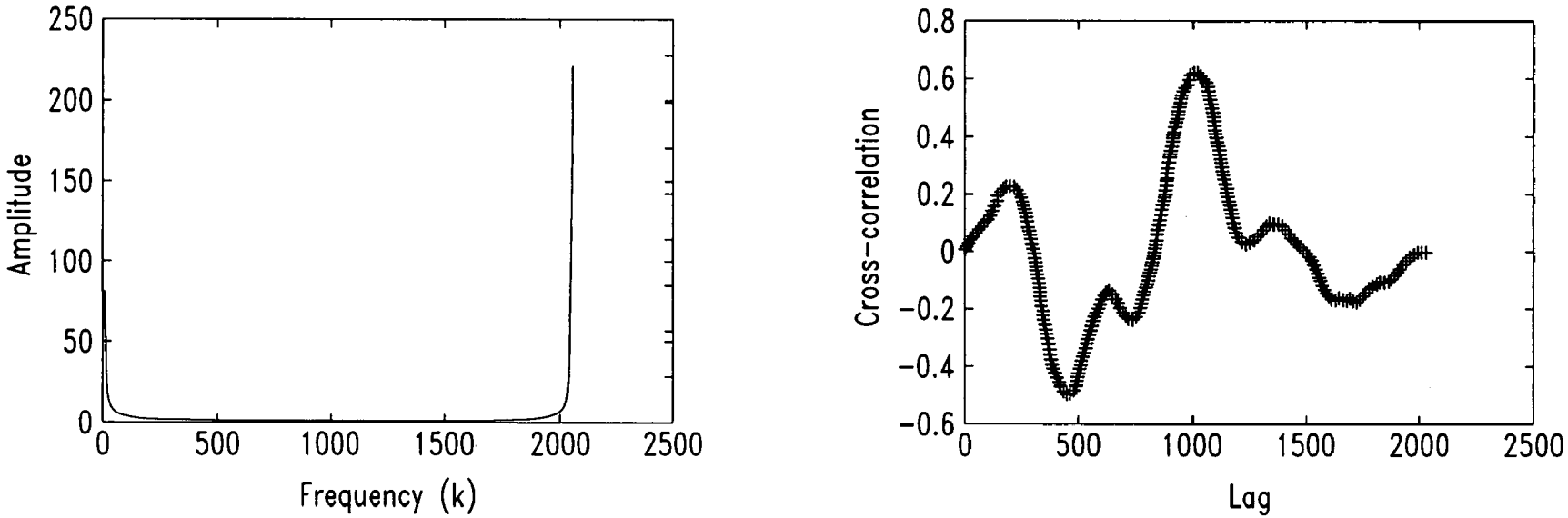
Figure 5D:
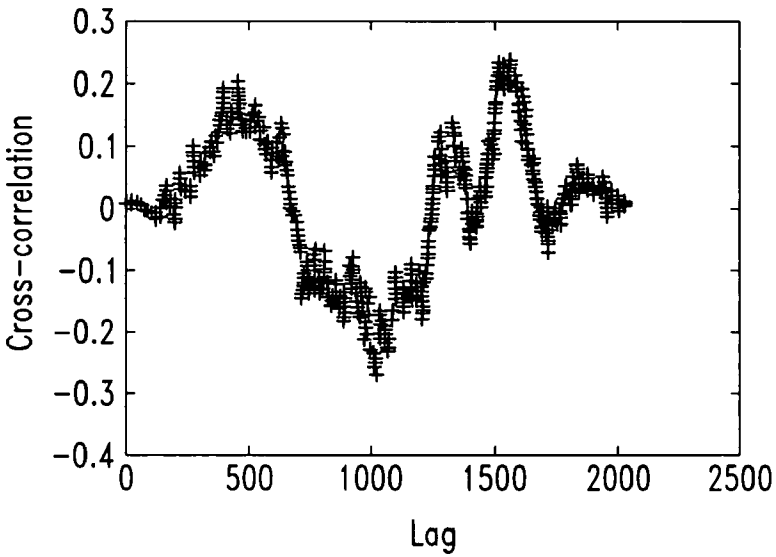
Figure 5D:
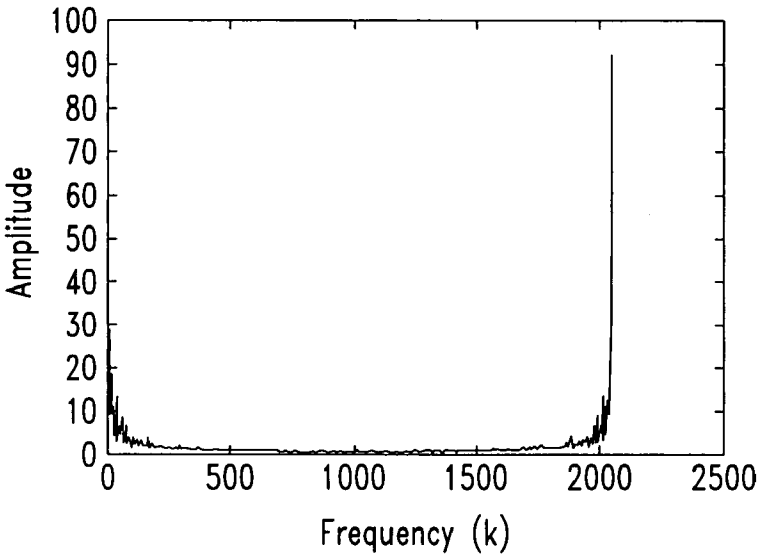

A voice activity detector (VAD) 10, as shown in FIG. 3, receives coded speech input signals, partitions the input signals into data frames and determines, for each frame, whether the data relates to voice or noise. The VAD 10 operates in the time domain and takes into account the inherent characteristics of speech and colored noise to provide improved distinction between speech and silenced sections of speech. The VAD 10 preferably executes a VAD process 12, as shown in FIG. 4.

Colored noise has the following fundamental properties:

1. White noise: the power of the noise is randomly distributed over the entire frequency spectrum and the correlation is very low.

2. Brown noise: the frequency spectrum, ($1/f^2$), is mostly dominant in the very low frequency regions. Brown noise has a high cross correlation like speech signals.

3. Pink noise: the frequency spectrum, (1/f), is mostly present in the low frequencies. The cross-correlation values of Pink noise are not comparable to those of speech signals.

FIG. 5 shows the frequency spectrum and cross-correlation of speech and colored noise signals, where the cross-correlation is computed by varying the lag from 0 to 2048 samples. As can be observed from FIG. 5(*a*), speech is highly correlated due to the higher number of harmonics in the spectrum. The correlation is also highly periodic.

Figure 7:
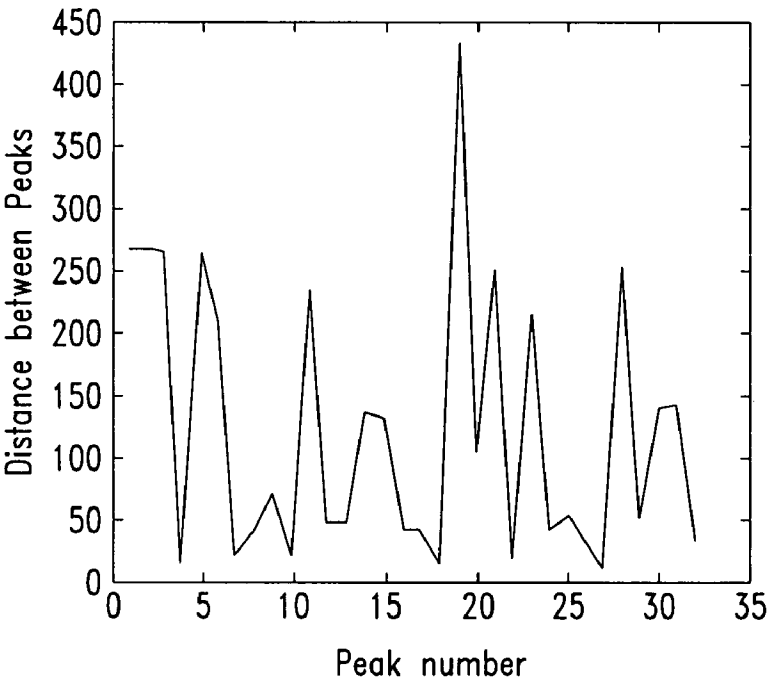
FIG. 7 is a graphical illustration showing the distance between adjacent peaks in the cross-correlation of brown noise signals.
Figure 6:
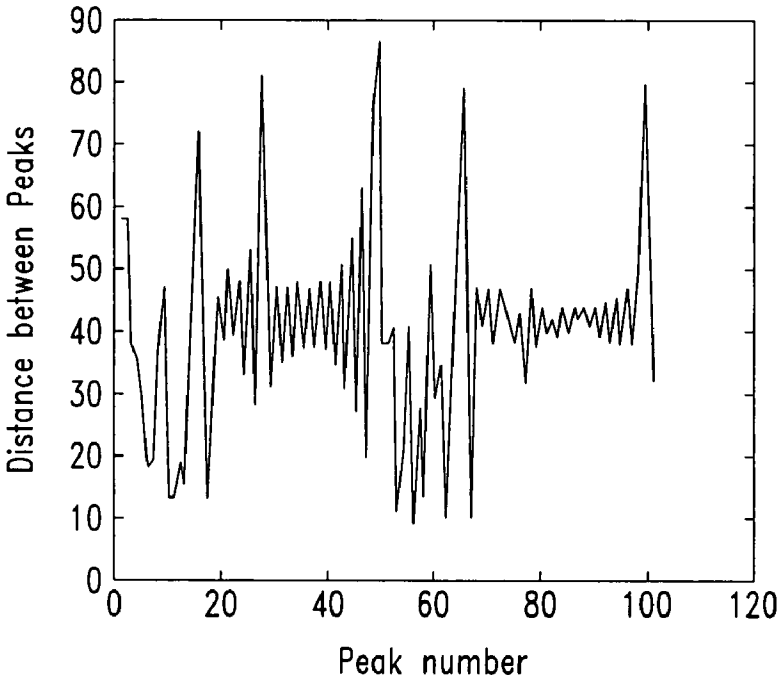
FIG. 6 is a graphical illustration showing the distance between adjacent peaks in the cross-correlation of speech signals.

The VAD 10 takes into account the above-described statistical parameters to improve the estimate of the initial frames. The cross-correlation of the signal is determined to obtain a VAD estimate in the initial frames of the input. Speech samples are highly correlated and the correlation is periodic in nature due to harmonics in the signal. FIG. 6 shows the distance between adjacent peaks in speech cross-correlation. FIG. 7 shows the distance between adjacent peaks in brown noise cross-correlation. As can be observed, the estimates of the periodicity of the peaks in the speech samples are more stable than those of pink and brown noise. A variance estimation method is described below that successfully differentiates between speech and noise.

After a certain number of frames, the energy threshold estimator also helps to improve the distinction between the voiced and silenced sections of the speech signal. The short-term energy signal is determined to adaptively improve the voiced/silence detection across a large number of frames.

The VAD 10 receives, at step 20 of the process shown in FIG. 4, Pulse Code Modulated (PCM) signals as input. In one embodiment, the input signal is sampled at 12,000 samples per second. The sampled PCM signals are divided into data frames, each frame containing 2048 samples. Each input frame is further partitioned into two sub-frames of 1024 samples each. Each pair of sub-frames is used to determine cross-correlation.

The VAD 10 then determines, at step 22, the amount of short-term energy in the input signal. The short-term energy is higher for voiced than un-voiced speech and should be zero for silent regions in speech. Short-term energy is calculated using the following formula:

$$E^l = \sum_{n=(l-1)N+1}^{l \cdot N} x(n)^2 \tag{1}$$

The energy in the $l^{th}$ analysis frame of size N is $E^l$. If m frames of the signal have been classified as voice, the average energy thresholds are determined, at step 22, as follows:

$$E_s^a = \frac{1}{m}\sum_{t=1}^{m} E^t \text{ and } E_n^a = \frac{1}{l-m}\sum_{t=1}^{l-m} E^t \tag{2}$$

where $E_s^a$ is the average speech energy over m frames classified as speech and $E_n^a$ is the average noise energy over (l-m) frames classified as noise.

If at step 22A the current data frame being processed is an $k^{th}$ data frame or greater in a series of data frames, the VAD 10 compares, at step 23, the energy of the current frame with the average speech energy $E_s^a$ to determine whether it contains speech or noise. In one embodiment, the $k^{th}$ data frame is the fifth data frame, however the scope of the present invention covers any value for the $k^{th}$ data frame. If yes, then the current data frame contains voice (step 23A). If no, then the current data frame contains noise (step 23B).

Otherwise, the VAD 10 determines, at step 24, the cross-correlation, $Y(\tau)$, of the first and second sub frames of the data frame under consideration as follows:

$$Y(\tau) = \sum_{n=0}^{N/2-1} x_1(n)x_2(n+\tau) \tag{3}$$

where, $\tau$ is the lag between the sequences, $x_1(n)$ is the first half of the input frame under consideration $x_2(n)$ is the second half of the input frame under consideration and N is the size of the frame.

Input signals with cross-correlation lower than a predetermined cross-correlation value (step 25) are considered as noise (step 23B). In one embodiment, the predetermined cross-correlation value is 0.4. This test therefore detects the presence of either white or pink noise in the data frame under consideration. Further tests are conducted to determine whether the current data frame is speech or brown noise.

As discussed above, the cross-correlation of speech samples is highly periodic. The periodicity of the cross-correlation of the current data frame is determined, at step 26, to segregate speech and noisy signals. The periodicity of the cross-correlation can be measured, with reference to FIG. 6, by determining the:

1. Distance between positive peaks: $\text{Diff}_{pp}$
2. Distance between negative peaks: $\text{Diff}_{nn}$
3. Distance between consecutive positive and negative peaks: $\text{Diff}_{pn}$
4. Distance between consecutive negative and positive peaks: $\text{Diff}_{np}$ The peaks can be identified by using:

$$Y(\tau-1)<Y(\tau)>Y(\tau+1) \text{ for maxima and}$$

$$Y(\tau-1)>Y(\tau)<Y(\tau+1) \text{ for minima.}$$

To ensure spurious peaks are not chosen, the process is extended to cover five lags on either side of a trial peak lag. Doing so makes the peak detection criteria stringent and does not entail a risk of leaving out genuine peaks in the cross correlation.

The variance of periodicity is determined at step 28. The variance $\sigma^2$ is a measure of how spread out a distribution is and is defined as the average squared deviation of each number in the sequence from its mean, i.e., $$\sigma^2 = \frac{\sum (x-\mu)^2}{L} \tag{4}$$

where x is the sequence whose variance is being measured and can be any of the $\text{Diff}_{xx}$ sequences mentioned in the previous section;

$\mu$ is the mean of sequence x; and

L is the number of samples in the sequence, i.e., the number of peaks in the different cases.

The estimate is normalized by L as the number of peaks in the correlation of speech and noisy samples will be different. To obtain an accurate estimate of the variance of the periodicity, a linear combination of the variances of the $\text{Diff}_{xx}$ is taken.

From FIG. 6, it can be seen that the mean of the $\text{Diff}_{xx}$ sequences of speech signals is higher as compared to that of noisy signals. To take into account the percentage variation of the $\text{Diff}_{xx}$ sequences from their respective means rather than the absolute variation, $\sigma^2$ is further normalized by $\mu^2$.

$$\varepsilon = \frac{\sigma^2}{\mu^2} = \frac{\sum (x-\mu)^2}{L \cdot \mu^2} = \frac{1}{L}\sum\left\{\left(\frac{x}{\mu}\right)-1\right\}^2 \tag{5}$$

Equation 5 varies according to $0<\epsilon<1$. The variance of the periodicity of the cross-correlation of speech signals is therefore lower than that of noise. The content of the relevant data frame may be considered to be voice (step 30) if the normalized variance $\epsilon$ is less than a predetermined variance value (step 29). For example, in one embodiment of the invention, the predetermined variance value is 0.2.

The VAD 10 experiences a delay of one data frame, i.e., the time taken for the first 2048 bits of sampled input signal to fill the first data frame. With a sampling frequency of 12 kHz, the VAD 10 will experience a lag of 0.17 seconds. The computation of the cross-correlation values for different lags takes minimal time. The VAD 10 may reduce the lag by reducing the frame size to 1024 samples. However, the reduced lag comes at the expense of increasing the error margin in the computation of the variance of the periodicity of the cross-correlation. This error can be reduced by overlapping the sub-frames used for the correlation.

Figure 1:
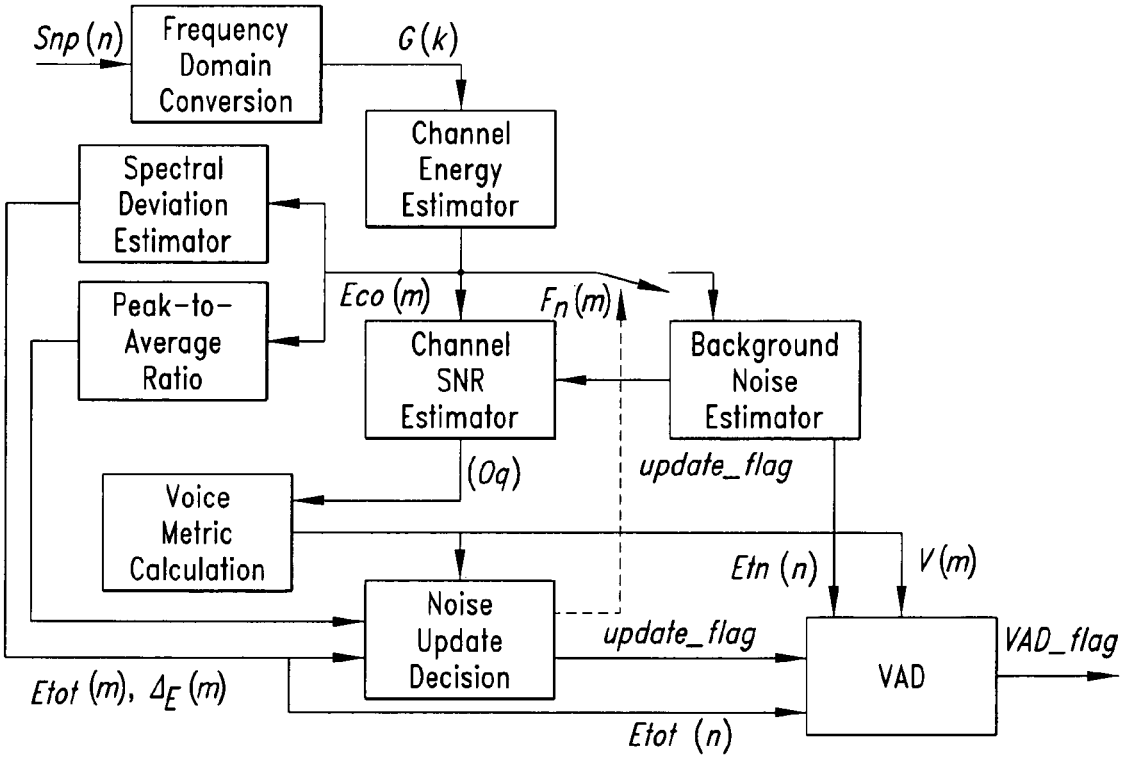
FIG. 1 (Prior Art)
FIG. 1 is a block diagram showing an ESTI Voice Activity Detector, according to the prior art.
Figure 2:
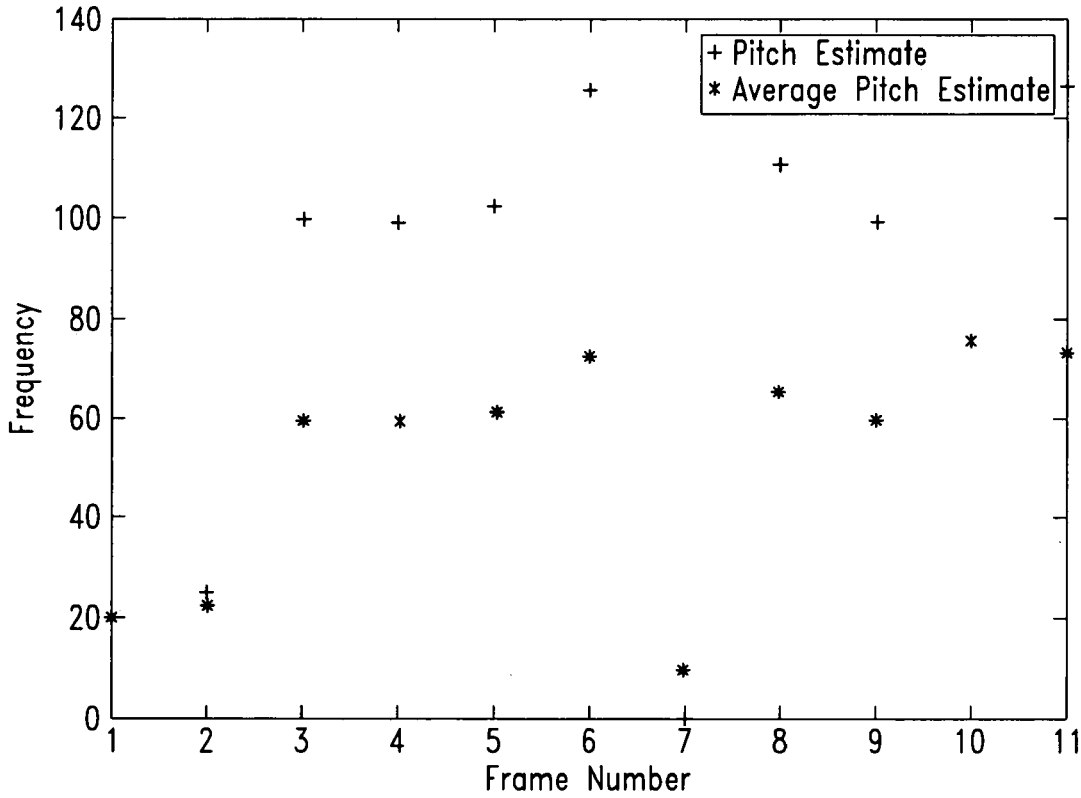
FIG. 2 (Prior Art)
FIG. 2 is a graphical illustration of pitch estimation of speech determined using a known voice activity detector, according to the prior art.
Figure 8:
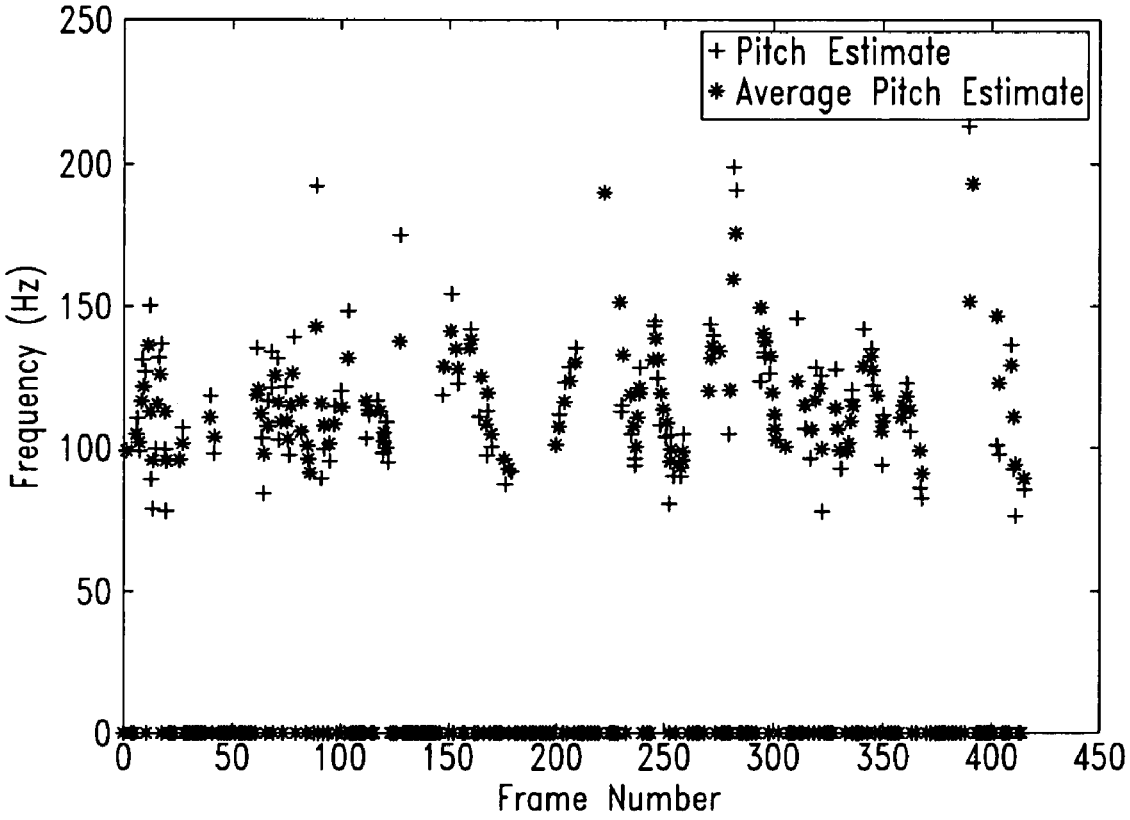
FIG. 8 is a graphical illustration of pitch estimation of speech determined using a voice activity detector in accordance with a preferred embodiment of the invention.

FIG. 8 shows the effect of the VAD 10 when used for pitch detection in a karaoke application. The average pitch estimate has improved in comparison with the pitch estimation shown in FIG. 2 obtained using a known VAD that gradually adapts the energy thresholds over a number of frames.

The number of computations required for the computation of the correlation values initially, reduce with higher number of frames, which dynamically adapt to the SNR of the input signal. The initial order of computational complexity is:

$$O(N)+O(N^2/2)+5\cdot O(K) \quad (7)$$

where

N is the number of samples in a frame; and

K is the number of peaks detected in the auto-correlation function.

In the steady state, when the energy thresholds have been determined, the order of complexity of the process VAD 10 reduces to $2\cdot O(N)$.

Figure 9:
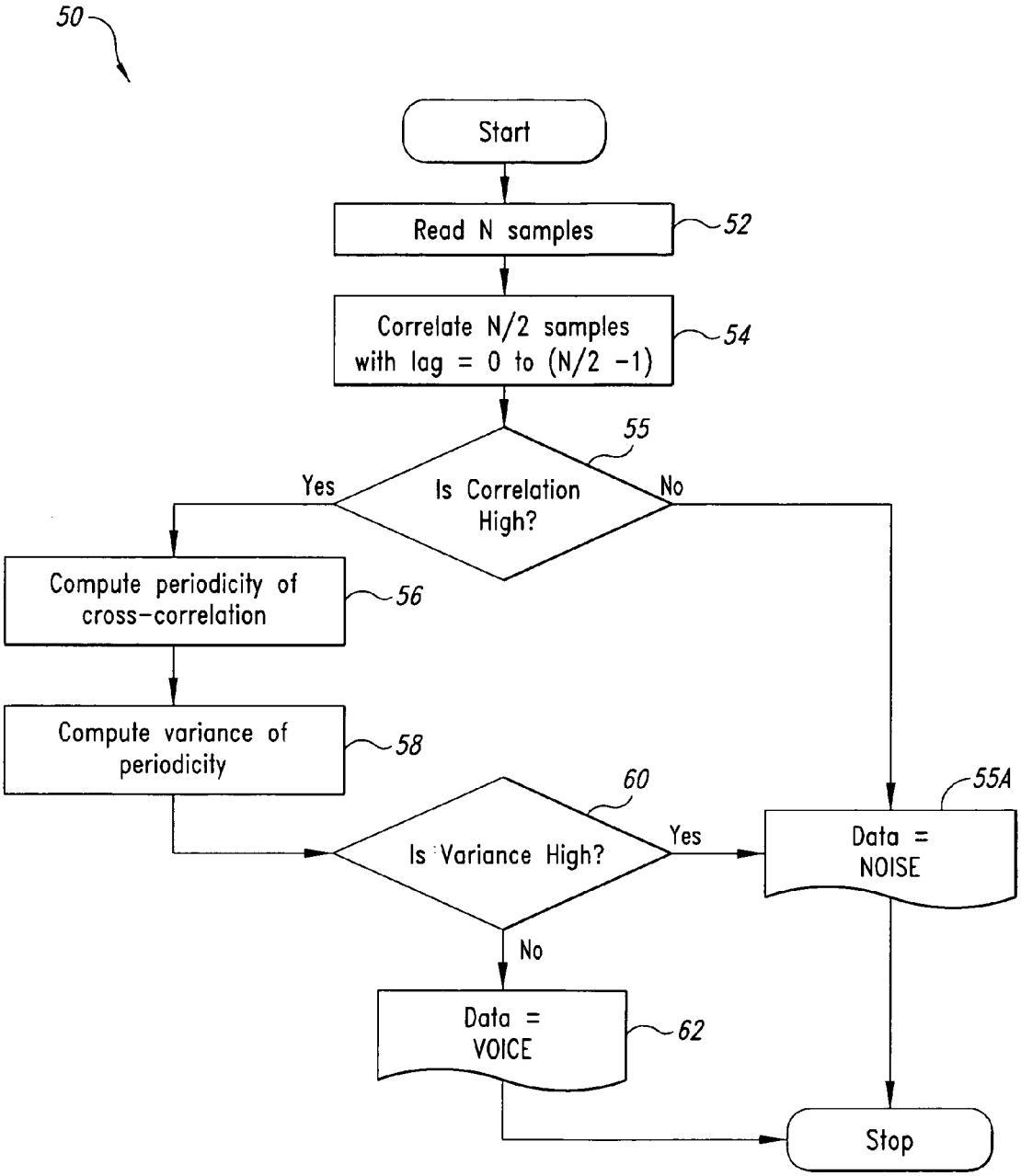
FIG. 9 is a flow diagram showing a process preferred by the voice activity detector.

The VAD 10 may alternatively execute a VAD process 50, as shown in FIG. 9. The VAD 10 receives, at step 52, Pulse Code Modulated (PCM) signals as input. The input signal is sampled at 12,000 samples per second. The sampled PCM signals are divided into data frames, each frame containing 2048 samples. Each input frame is further partitioned into two sub-frames of 1024 samples each. Each pair of sub-frames is used to determine cross-correlation.

The VAD 10 determines, at step 54, the cross-correlation, $Y(\tau)$, of the first and second sub frames of the data frame under consideration using Equation (3). Input signals with cross-correlation lower than 0.4 (step 55) are considered as noise (step 55A). This test therefore detects the presence of either white or pink noise in the data frame under consideration. Further tests are conducted to determine whether the current data frame is speech or brown noise.

As discussed above, the cross-correlation of speech samples is highly periodic. If the cross-correlation is high, the periodicity of the cross-correlation of the current data frame is determined, at step 56, to segregate speech and noisy signals. The periodicity of the cross-correlation can be measured in the above-described manner with reference to FIG. 6.

The variance of periodicity is determined at step 58 in the above-described manner. The estimate is normalized by L as the number of peaks in the correlation of speech and noisy samples will be different. To obtain an accurate estimate of the variance of the periodicity, a linear combination of the variances of the $Diff_{xx}$ is taken.

From FIG. 6, it can be seen that the mean of the $Diff_{xx}$ sequences of speech signals is higher as compared to that of noisy signals. To take into account the percentage variation of the $Diff_{xx}$ sequences from their respective means rather than the absolute variation, $\sigma^2$ further normalized by $\mu^2$ as given by Equation 5. The variance of the periodicity of the cross-correlation of speech signals is therefore lower than that of noise. The content of the relevant data frame may be considered to be voice (step 62) if $\epsilon<0.2$ (step 60), for example.

In one embodiment, the VAD 10 sets a flag indicating whether the contents of the relevant data frame is voice.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method, comprising:

receiving coded speech signals;

partitioning the coded speech signals into data frames; and for each of at least some of the data frames, determining whether the data frame corresponds to voice or to noise, by:

determining a cross-correlation $Y(\tau)$ of data of said data frame;

determining a periodicity of the cross-correlation;

determining a variance $\sigma^2$ of the periodicity;

determining said data frame corresponds to said noise when the cross-correlation is lower than a threshold cross-correlation value; and determining said data frame corresponds to said voice if the variance is less than a threshold variance value.

2. The method claimed in claim 1, wherein the cross-correlation, $Y(\tau)$, is calculated in accordance with the following:

$$Y(\tau) = \sum_{n=0}^{N/2-1} x_1(n)x_2(n+\tau)$$

where, $\tau$ is a lag between sequences $x_1(n)$ and $x_2(n)$;

$x_1(n)$ is a first half of said data frame;

$x_2(n)$ is a second half of said data frame; and

N is the size of the frame.

3. The method claimed in claim 2, wherein the periodicity is determined by measuring at least one of:

a distance $Diff_{pp}$ between positive peaks;

a distance $Diff_{nn}$ between negative peaks;

a distance $Diff_{pn}$ between consecutive positive and negative peaks; and a distance $Diff_{np}$ between consecutive negative and positive peaks, where the peaks are identified by using:

$$Y(\tau-1)<Y(\tau)>Y(\tau+1) \text{ for maxima and}$$

$$Y(\tau-1)>Y(\tau)<Y(\tau+1) \text{ for minima.}$$

4. The method claimed in claim 3, wherein the variance, $\sigma^2$, is calculated as follows:

$$\sigma^2 = \frac{\sum (x-\mu)^2}{L}$$

where x is a sequence comprised of the periodicity whose variance is being measured;

$\mu$ is the mean of the sequence x; and

L is the number of samples in the sequence.

5. The method claimed in claim 4, wherein the variance is normalized by $\mu^2$ substantially as follows:

$$\varepsilon = \frac{\sigma^2}{\mu^2} = \frac{\sum (x-\mu)^2}{L\cdot\mu^2} = \frac{1}{L}\sum\left\{\left(\frac{x}{\mu}\right)-1\right\}^2.$$

6. The method claimed in claim 5, wherein the threshold variance value is 0.2.

7. The method claimed in claim 1, wherein the threshold cross-correlation value corresponds to that of white or pink noise.

8. The method claimed in claim 1, wherein the threshold cross-correlation value is 0.4.

9. A method, comprising:

receiving coded speech signals;

partitioning the coded speech signals into data frames; and for each of at least some of the data frames, determining whether the data frame corresponds to voice or to noise, by:

determining an energy of said data frame;

determining an average speech energy of the coded speech signal;

if the data frame is one of a threshold number of initial data frames of the coded speech signal, determining whether the data frame corresponds to said voice or to said noise by, determining a cross-correlation of data of said data frame, determining a periodicity of the cross-correlation, determining a variance of the periodicity;

determining said data frame corresponds to said noise when the cross-correlation is lower than a threshold cross-correlation value; and determining said data frame corresponds to said voice if the variance is less than a threshold variance value; and else, comparing the energy of the data frame with the average speech energy, and determining said data frame corresponds to said voice if the average speech energy is less than or equal to the energy of the data frame.

10. The method claimed in claim 9, wherein determining the energy of the data frame comprises determining:

$$E^l = \sum_{n=(l-1),N+1}^{l\cdot N} x(n)^2$$

where the energy in an $l^{th}$ analysis frame of size N is $E^l$.

11. The method claimed in claim 10, wherein the average speech energy determined over k data frames is as follows:

$$E_s^a = \frac{1}{k}\sum_{l=1}^{k} E^l.$$

12. A voice activity detector, comprising:

means for determining whether a data frame of a coded speech signal corresponds to voice or to noise, including:

means for determining a cross-correlation $Y(\tau)$ of data of said data frame;

means for determining a periodicity of the cross-correlation;

means for determining a variance $\sigma^2$ of the periodicity;

means for determining said data frame corresponds to said noise when the cross-correlation is lower than a threshold cross-correlation value; and means for determining said data frame corresponds to voice if the variance is less than a threshold variance value.

13. The voice activity detector claimed in claim 12, wherein the cross-correlation, $Y(\tau)$, is calculated in accordance with the following:

$$Y(\tau) = \sum_{n=0}^{N/2-1} x_1(n)x_2(n+\tau)$$

where, $\tau$ is a lag between sequences $x_1(n)$ and $x_2(n)$;

$x_1(n)$ is a first half of said data frame;

$x_2(n)$ is a second half of said data frame; and

N is the size of the frame.

14. The voice activity detector claimed in claim 13, wherein the periodicity is determined by measuring at least one of:

a distance $\text{Diff}_{pp}$ between positive peaks;

a distance $\text{Diff}_{nn}$ between negative peaks;

a distance $\text{Diff}_{pn}$ between consecutive positive and negative peaks; and a distance $\text{Diff}_{np}$ between consecutive negative and positive peaks, wherein the peaks are identified by using:

$Y(\tau-1)<Y(\tau)>Y(\tau+1)$ for maxima and $Y(\tau-1)>Y(\tau)<Y(\tau+1)$ for minima 15. The voice activity detector claimed in claim 14, wherein the variance, $\sigma^2$, is calculated as follows:

$$\sigma^2 = \frac{\sum (x-\mu)^2}{L}$$

where x is a sequence comprised of the periodicity whose variance is being measured;

$\mu$ is the mean of the sequence x; and

L is the number of samples in the sequence.

16. The voice activity detector claimed in claim 15, wherein the variance is normalized by $\mu^2$ substantially as follows:

$$\varepsilon = \frac{\sigma^2}{\mu^2} = \frac{\sum (x-\mu)^2}{L\cdot\mu^2} = \frac{1}{L}\sum\left\{\left(\frac{x}{\mu}\right)-1\right\}^2.$$

17. The voice activity detector claimed in claim 16, wherein the threshold variance value is 0.2.

18. The voice activity detector claimed in claim 12, wherein the threshold cross-correlation value corresponds to that of white or pink noise.

19. The voice activity detector claimed in claim 12, wherein the threshold cross-correlation value is 0.4.

* * * * *

UNITED STATES PATENT AND TRADEMARK OFFICE

CERTIFICATE OF CORRECTION

PATENT NO. : 7,653,537 B2
APPLICATION NO. : 10/951545
DATED : January 26, 2010
INVENTOR(S) : Padhi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1415 days.

Signed and Sealed this

Twenty-third Day of November, 2010

David J. Kappos

David J. Kappos
*Director of the United States Patent and Trademark Office*